US007695816B2

(12) United States Patent
Peters et al.

(10) Patent No.: US 7,695,816 B2
(45) Date of Patent: Apr. 13, 2010

(54) COMPOSITE ARTICLE AND METHOD OF FORMING THE SAME

(75) Inventors: David D. Peters, Wyandotte, MI (US); Michael C. May, Clawson, MI (US)

(73) Assignee: BASF Corporation, Florham Park, NJ (US)

( * ) Notice: Subject to any disclaimer, the term of this patent is extended or adjusted under 35 U.S.C. 154(b) by 786 days.

(21) Appl. No.: 11/533,903

(22) Filed: Sep. 21, 2006

(65) Prior Publication Data

US 2008/0076588 A1 Mar. 27, 2008

(51) Int. Cl.
*B32B 27/40* (2006.01)
*B05D 1/38* (2006.01)

(52) U.S. Cl. ..... 428/424.2; 428/424.4; 427/331; 427/379; 427/384; 427/407.1

(58) Field of Classification Search ..... 428/423.1, 428/423.7, 424.2, 424.4; 427/331, 372.2, 427/379, 384, 407.1
See application file for complete search history.

(56) References Cited

U.S. PATENT DOCUMENTS

| | | | | |
|---|---|---|---|---|
| 3,879,248 | A * | 4/1975 | Kest | 156/289 |
| 4,389,454 | A | 6/1983 | Horacek et al. | |
| 4,916,016 | A | 4/1990 | Bristowe et al. | |
| 5,116,557 | A | 5/1992 | Debaes et al. | |
| 5,118,728 | A | 6/1992 | Primeaux | |
| 5,171,818 | A | 12/1992 | Wilson | |
| 5,215,796 | A | 6/1993 | Mueller et al. | |
| 5,232,996 | A | 8/1993 | Shah et al. | |
| 5,543,225 | A | 8/1996 | Mueller et al. | |
| 5,595,701 | A | 1/1997 | MacGregor et al. | |
| 5,639,546 | A | 6/1997 | Bilkadi | |
| 5,985,986 | A | 11/1999 | Kubitza et al. | |
| 6,026,760 | A | 2/2000 | Phillips et al. | |
| 6,092,343 | A | 7/2000 | West et al. | |
| 6,130,270 | A | 10/2000 | Ukon et al. | |
| 6,509,086 | B1 | 1/2003 | Schroder et al. | |
| 7,150,899 | B2 * | 12/2006 | Onoyama et al. | 427/470 |

FOREIGN PATENT DOCUMENTS

| | | |
|---|---|---|
| WO | WO 01/30879 A1 | 5/2001 |

* cited by examiner

*Primary Examiner*—Thao T. Tran
(74) *Attorney, Agent, or Firm*—Howard & Howard Attorneys PLLC

(57) ABSTRACT

A composite article comprises a first layer resulting from the reaction of at least one ethylenically unsaturated monomer and a second layer different than the first layer and resulting from the reaction of an isocyanate-reactive resin and a polyisocyanate. Adhesion promoter is dispersed in at least one of the first layer and the second layer. The adhesion promoter comprises a first reactive end group selected from the group of an ethylenically unsaturated monomer, an ethylenically unsaturated acrylate monomer, an ethylenically unsaturated methacrylate monomer, or a combination thereof and a second reactive end group that reacts with isocyanate. The adhesion promoter reacts into the first and second layers through differentially reactive groups such that the adhesion promoter is compatible with the first and second layers to improve adhesion therebetween. A method of forming the composite article is also disclosed.

24 Claims, No Drawings

COMPOSITE ARTICLE AND METHOD OF FORMING THE SAME

BACKGROUND OF THE INVENTION

1. Field of the Invention

The subject invention relates to a composite article and a method of forming the same, and specifically, to a composite article having improved adhesion between layers.

2. Description of the Related Art

Bowling balls can be comprised of a core and a cover stock surrounding the core. Additional layers or components may be present in the core resulting in an inner and outer core to vary different properties of the bowling ball, mainly performance. The inner core is typically a center weight within the bowling ball and may be formed of various materials. The inner core may not be spherical and is shaped to enhance performance by effecting the precession or flare of the bowling ball. As understood by those of ordinary skill in the art, these performance weights can be, but not limited to being, oblong, boomerang shaped, dog bone shaped, etc. The outer core is the layer between the inner core and the cover stock and provides a spherical core. The coverstock is the outermost shell of the bowling ball. There are different types of materials that may form the coverstock, such as, polyester and polyurethane compositions.

The type of material forming the cover stock is selected depending upon the desired reactivity of the bowling ball when rolled and the desired on-lane performance. For example, cover stocks formed of polyester are very durable and hard, but the polyester cover stocks have low friction on oiled lane surfaces. This low friction causes the bowling ball to skid more and maintain a straighter trajectory when rolled, i.e., less hook is achieved. Polyurethane cover stocks, on the other hand, tend to be softer, have different polymer morphology compared to polyester balls and have higher friction. The higher friction can cause the bowling ball to be more reactive on the bowling lane and perform better. Additional additives may be added to the polyurethane coverstock to provide different levels of texture and effective friction, such as resins, ceramics, or glass particles.

Polyurethane materials have been used for bowling ball coverstocks for many years. Polyurethane materials are used industry-wide for professional bowling balls (and high-end amateur products) because they provide the necessary on-lane performance desired at the higher levels of play.

The polyurethane materials of the related art generally comprise the reaction product of a polyol and a polyisocyanate forming cross-linkages with the polyol and having a non-reactive diluent dispersed within the matrix. The non-reactive diluent is typically a plasticizer and is one of the most important elements contributing to ball reactivity. Plasticizers such as 2,2,4-trimethyl-1,3-pentanediol diisobutyrate (Kodaflex "TXIB"), from Eastman Chemical Company, are used in such polyurethane elastomeric materials.

Typically, bowling ball cores can be constructed using various materials. The most common materials are unsaturated polyesters, especially, styrenated polyesters. Advances in core designs have resulted in the development of a round core that is constructed from an inner geometric shape, or inner core, and a shell cast around this inner core forming an outer core. The outer core must be prepared using materials that adhere well to the cover stock. Most bowling balls are drilled with holes to fit a user's hand and fingers. When the bowling ball is drilled, the interface between the outer core and the cover stock undergoes increased stresses. If the cover stock and outer core are not sufficiently adhered to one another, the bowling ball core can separate from the cover stock and/or crack between the finger holes. Still another issue present in the related art is that the outer core has a tendency to shrink over time after production, which further increases the stresses at the interface between the outer core and the cover stock.

The use of hydroxyethyl methacrylate (HEMA) as an adhesion promoter is well known. U.S. Pat. Nos. 5,639,546 and 6,509,086 disclose the use of HEMA to promote adhesion in composite articles. However, the '546 patent requires a radical curing process and is unlikely to form a thin film. Moreover, the polyethylenically unsaturated monomers form a cured layer that promotes adhesion when cured with a photoinitiator. The '086 patent discloses a system that incorporates a urethane acrylate as an additive to the acrylate layer. The result of such a system is two similar polymer layers that do not have dual adhesive and cohesive forces interacting between the layers.

Most related art systems wipe or spray the adhesion promoter directly onto the first layer prior to casting the second layer. Such an additional step results in additional time required in manufacturing, potentially exposing employees to added chemical exposure hazards, and there questions whether there is adequate assurances that the adhesion promoter has sufficiently bonded with the first layer prior to casting the second layer.

SUMMARY OF THE INVENTION AND ADVANTAGES

The subject invention provides a composite article comprising a first layer comprising a polymer and a second layer different than the first layer and comprising a polyurethane. The polymer results from the reaction of at least one ethylenically unsaturated monomer. The polyurethane results from the reaction of an isocyanate-reactive resin and a polyisocyanate. An adhesion promoter is dispersed in at least one of the first layer and the second layer. The adhesion promoter comprises a first reactive end group selected from the group of an ethylenically unsaturated monomer, an ethylenically unsaturated acrylate monomer, an ethylenically unsaturated methacrylate monomer, or a combination thereof and a second reactive end group that reacts with isocyanate. The adhesion promoter reacts into the first and second layers through differentially reactive groups such that the adhesion promoter is compatible with the first and second layers to improve adhesion therebetween.

The subject invention further provides a method of forming the composite article. The method comprises casting the first and second layers and dispersing the adhesion promoter throughout one of the first and the second layers prior to casting. The method also comprises reacting the adhesion promoter into the first and second layers through differentially reactive groups such that the adhesion promoter is compatible with the first and second layers to improve adhesion therebetween.

The subject invention is particularly suited for applications involving multiple casting steps and those having, but not limited to, a spherical shape of the final composite articles. As a result of the adhesion promoter, the first and second layers are adhesively and cohesively bonded to one another and afford an increased bonding strength. Further, the first and second layers have a reduced likelihood of separating when stresses are applied to the interface between the layers. Another advantage of the subject invention is a shorter processing time since the adhesion promoter is dispersed through either the first and/or the second layers prior to casting, as opposed to be applied as a layer between the first and second layers.

DETAILED DESCRIPTION OF THE INVENTION

A composite article is disclosed. More specifically, the composite article comprises a first layer and a second layer and the subject invention promotes adhesion between the first and second layer such that the composite article has improved adhesion therebetween. The subject invention may be useful with many applications, but is particularly useful with composite articles that are spherical such that the second layer surrounds the first layer. For example, the first and second layers may be spherical and concentric. The first layer may be a core and the second layer may be a coverstock such that the cover stock completely surrounds the core. In one such illustrative application, but not limited thereto, the composite article comprises a bowling ball.

The first layer comprises a polymer resulting from the reaction of at least one ethylenically unsaturated monomer. It is to be appreciated by those of ordinary skill in the art that the ethylenically unsaturated monomer is able to react with itself or any other monomer that will react in a free-radical cross-linking reaction to form the polymer. In one embodiment, the ethylenically unsaturated monomer of the polymer may be an unsaturated polyester. It is to be appreciated that polyester polyols and amides are included under the term unsaturated polyester, so long as at least one site of unsaturation remains in the polyester polyol and amide. Further, it is understood the unsaturated polyester includes various reactive monomers, such as, but not limited to styrene and that these polyesters are produced through typical chemical processes and with standard reagents that are well known in the art.

In another embodiment, the ethylenically unsaturated monomer of the polymer may be selected from the group of ethylenically unsaturated acrylate monomers, ethylenically unsaturated methacrylate monomers, and combinations thereof. Preferably, the polymer is selected from the group of hydroxyethyl methacrylate, hydroxypropyl methacrylate, hydroxybutyl methacrylate, hydroxyethyl acrylate, hydroxypropyl acrylate, hydroxybutyl acrylate, and combinations thereof. More preferably, the polymer comprises hydroxyethyl methacrylate or hydroxyethyl acrylate.

The second layer is different than the first layer and comprises a polyurethane. The polyurethane results from the reaction of an isocyanate-reactive resin and a polyisocyanate. The second layer preferably has a thickness of from about 0.33 inches to about 2.0 inches. However, it is to be appreciated that this second layer may be thicker than 2.0 inches depending on the required physical properties and desired application.

The isocyanate-reactive resin includes, among other components, at least one polyol. Preferably, the isocyanate-reactive resin includes a plurality of polyols. Although polyether polyols are preferred, the at least one polyol may also include polyester polyols. The polyester polyol may, or may not, be ethylenically unsaturated but will contain isocyanate-reactive functional groups.

Suitable polyols in the isocyanate-reactive resin include, but are not limited to, phthalic anhydride-initiated polyester polyols, aromatic amine-initiated polyols, aliphatic amine-initiated polyols, polyoxyalkylene polyether polyols, polycaprolactone polyols, polythioether polyols, polyester amides and polyacetals containing hydroxyl groups, aliphatic polycarbonates containing hydroxyl groups, amine terminated polyoxyalkylene polyethers, polyester polyols, other polyoxyalkylene polyether polyols, graft dispersion polyols, and combinations thereof.

Included among the polyoxyalkylene polyether polyols are polyoxyethylene polyols, polyoxypropylene polyols, polyoxybutylene polyols, polytetramethylene polyols, and heteric and block copolymers. The block copolymers may include, for example combinations of polyoxypropylene and polyoxyethylene, poly-1,2-oxybutylene and polyoxyethylene polyols, poly-1,4-tetramethylene and polyoxyethylene polyols, and copolymer polyols prepared from blends or sequential addition of two or more alkylene oxides. The polyoxyalkylene polyether polyols may be prepared by any known process such as, for example, the process disclosed by Wurtz in 1859, *Encyclopedia of Chemical Technology*, Vol. 7, pp. 257-262, published by Interscience Publishers, Inc. (1951) or in U.S. Pat. No. 1,922,459. The alkylene oxides may be added to the initiator compound individually, sequentially one after the other to form blocks, or in mixtures to form a random copolymer, or heteric polyether polyol. The polyoxyalkylene polyether polyols may have either primary or secondary hydroxyl groups.

The polyoxyalkylene polyether polyols may be aromatic amine-initiated or aliphatic amine-initiated polyoxyalkylene polyether polyols. The amine-initiated polyols may be polyether polyols terminated with a secondary hydroxyl group through addition of, for example, propylene oxide as the terminal block. It is preferred that the amine-initiated polyols contain 50 weight percent or more, and up to 100 weight percent, of secondary hydroxyl group forming alkylene oxides, such as polyoxypropylene groups, based on the weight of all oxyalkylene groups. This amount can be achieved by adding 50 weight percent or more of the secondary hydroxyl group forming alkylene oxides to the initiator molecule in the course of manufacturing the polyol.

As described above, suitable initiator compounds for the polyol include primary or secondary amines. These would include, for the aromatic amine-initiated polyether polyol, the aromatic amines such as aniline, N-alkylphenylene-diamines, 2,4'-, 2,2'-, and 4,4'-methylenedianiline, 2,6- or 2,4-toluenediamine, vicinal toluenediamines, o-chloro-aniline, p-aminoaniline, 1,5-diaminonaphthalene, methylene dianiline, the various condensation products of aniline and formaldehyde, and the isomeric diaminotoluenes, with preference given to vicinal toluenediamines.

For the aliphatic amine-initiated polyol, any aliphatic amine, whether branched or unbranched, substituted or unsubstituted, saturated or unsaturated, may be used. These would include, as examples, mono-, di-, and trialkanolamines, such as monoethanolamine, methylamine, triisopropanolamine; and polyamines such as ethylene diamine, propylene diamine, diethylenetriamine; or 1,3-diaminopropane, 1,3-diaminobutane, and 1,4-diaminobutane. Preferable aliphatic amines include any of the diamines and triamines, most preferably, the diamines.

The polyoxyalkylene polyether polyols may generally be prepared by polymerizing alkylene oxides with polyhydric amines. Any suitable alkylene oxide may be used such as ethylene oxide, propylene oxide, butylene oxide, and combinations of these oxides. The polyoxyalkylene polyether polyols may be prepared from other starting materials such as tetrahydrofuran and alkylene oxide-tetrahydrofuran mixtures; epihalohydrins such as epichlorohydrin; as well as aralkylene oxides such as styrene oxide.

Also suitable are polymer modified polyols, in particular, the so-called graft polyols. Graft polyols are well known to the art and are prepared by the in situ polymerization of one or more vinyl monomers, preferably acrylonitrile and styrene, in the presence of a polyether polyol, particularly polyols containing a minor amount of natural or induced unsaturation. Methods of preparing such graft polyols may be found in columns 1-5 and in the Examples of U.S. Pat. No. 3,652,639; in columns 1-6 and in the Examples of U.S. Pat. No. 3,823,201; in columns 2-8 and in the Examples of U.S. Pat. No. 4,690,956; and in U.S. Pat. No. 4,524,157; all of which patents are herein incorporated by reference.

Non-graft polymer modified polyols are also suitable, for example, as those prepared by the reaction of a polyisocyanate with an alkanolamine in the presence of a polyether polyol as taught by U.S. Pat. Nos. 4,293,470; 4,296,213; and 4,374,209; dispersions of polyisocyanurates containing pendant urea groups as taught by U.S. Pat. No. 4,386,167; and polyisocyanurate dispersions also containing biuret linkages as taught by U.S. Pat. No. 4,359,541. Other polymer modified polyols may be prepared by the in situ size reduction of polymers until the particle size is less than 20 μm, preferably less than 10 μm.

In a preferred embodiment of the subject invention, the isocyanate-reactive resin of the polyurethane includes first and second polyols. Preferably, the first polyol, a polyether polyol, is present in an amount of from 20 to 50, more preferably from 20 to 40, parts by weight of the isocyanate-reactive resin. One suitable first polyol is an ethylene diamine initiated propylene oxide polyol, which is commercially available as QUADROL® from BASF Corporation having a functionality of about 4, a molecular weight of about 292, and hydroxyl number of about 800. Another suitable first polyol is commercially available as PLURACOL® 2097 from BASF Corporation having a functionality of about 3, a molecular weight of about 4000, and hydroxyl number of about 35.

The second polyol is preferably present in an amount of from 10 to 50, more preferably from 10 to 40, parts by weight of the isocyanate-reactive resin. A suitable second polyol is PLURACOL® GP730 Polyol from BASF Corporation having a functionality of 2.99, a molecular weight of 730, hydroxyl number of 230, and 100% PO. Another suitable second polyol is commercially available as PLURACOL® 736 from BASF Corporation having a functionality of about 4, a molecular weight of about 550, and hydroxyl number of about 380-400.

In addition to the at least one polyol, the isocyanate-reactive resin may further include a supplemental chain extender. The chain extender is preferably a diol or a mixture of diols. Such diols preferably include any aliphatic, cycloaliphatic, and/or araliphatic diol having from 2 to 14 carbon atoms, more preferably from 4 to 10 carbon atoms. The supplemental chain extender helps achieve desired physical properties of the polyurethane and therefore in the overall composite article.

Preferably, the diol selected is diethylene glycol (DEG). Alternative chain extenders include, but are not limited to, ethylene glycol, propylene glycol, 1,4-butanediol, 1,5-pentane diol, 1,6-hexanediol, 1,3-propanediol, 1,10-decanediol, o-, m-, and p-dihydroxycyclohexane, diethylene glycol, dipropylene glycol, primary and secondary aromatic diamines, 3,3'-di- and/or 3,3'-, 5,5'-tetraalkyl-substituted diaminodiphenyl-methanes, and bis(2-hydroxyethyl)hydroquinone. The chain extender typically has a number average molecular weight of less than 400, preferably from 60 to 300 and is present in an amount of from 10 to 30, more preferably from 14 to 20, parts by weight based on 100 parts by weight of the isocyanate-reactive resin. Triols such as 1,2,4- and 1,3,5-trihydroxycyclohexane, glycerol, and trimethylolpropane, and combinations thereof can also be used as chain extenders. The polyurethane can also be prepared by using mixtures of diols and triols as the chain extenders.

The isocyanate-reactive resin may also include one or more additives directed at enhancing the performance of one or more physical properties of the composite and/or the polyurethane. For instance, the additive or additives may be selected from the group consisting of, but not limited to, surfactants, cell regulator, flame retardants, wetting agents, fillers, dyes, water scavengers, anti-foam agents, catalysts, UV performance enhancers, pigments, hindered amine light stabilizers, and combinations thereof. Other suitable additives include, but are not limited to, cell regulators, hydrolysis-protection agents, fungistatic and bacteriostatic substances, dispersing agents, adhesion promoters, and appearance enhancing agents. Although the subject invention is not intended to be limited to these examples, some specific examples of these additives include aluminum tri-hydrate, calcium carbonate, gypsum, wollastonite, phosphorus, silica, glass including glass beads, calcium sulfate, and magnesium hydroxide.

A catalyst may be employed as an additive to greatly accelerate the reaction between the isocyanate-reactive resin and the polyisocyanate of the polyurethane. Examples of suitable catalysts are organometallic catalysts, preferably organotin catalysts, although it is possible to employ metals such as aluminum, zirconium, lead, titanium, copper, mercury, cobalt, nickel, iron, vanadium, antimony, and manganese. Suitable organometallic catalysts, exemplified here by tin as the metal, are represented by the formula: $R_nSn[X—R^1—Y]_2$, wherein R is a $C_1$-$C_8$ alkyl or aryl group, $R^1$ is a $C_1$-$C_{18}$ methylene group optionally substituted or branched with a $C_1$-$C_4$ alkyl group, Y is hydrogen or a hydroxyl group, preferably hydrogen, X is methylene, an —S—, an —$SR^2$COO—, —SOOC—, an —$O_3$S—, or an —OOC— group wherein $R^2$ is a $C_1$-$C_4$ alkyl, n is 0 or 2, provided that $R^1$ is $C_0$ only when X is a methylene group.

Specific examples of suitable catalysts are tin (II) acetate, tin (II) octanoate, tin (II) ethylhexanoate and tin (II) laurate; and dialkyl (from 1 to 8 carbon atoms) tin (IV) salts of organic carboxylic acids having 1-32 carbon atoms, preferably 1-20 carbon atoms, e.g., diethyltin diacetate, dibutyltin diacetate, dibutyltin dioctoate, dibutyltin dilaurate, dibutyltin maleate, dihexyltin diacetate, and dioctyltin diacetate. Other suitable organotin catalysts are organotin alkoxides and mono or polyalkyl (from 1 to 8 carbon atoms) tin (IV) salts of inorganic compounds such as butyltin trichloride, dimethyl- and diethyl- and dibutyl- and dioctyl- and diphenyl- tin oxide, dibutyltin dibutoxide, di(2-ethylhexyl) tin oxide, dibutyltin dichloride, and dioctyltin dioxide. Preferred, however, are tin catalysts with tin-sulfur bonds which are resistant to hydrolysis, such as dialkyl (from 1 to 20 carbon atoms) tin dimercaptides, including dimethyl-, dibutyl-, and dioctyl- tin dimercaptides.

As for catalysis of the reaction between the isocyanate-reactive resin and the polyisocyanate, in addition to the catalysts already identified above, tertiary amines may also be used to promote urethane linkage formation in the polyurethane. These amines include triethylamine, 3-methoxypropyldimethylamine, triethylenediamine, tributylamine, dimethylbenzylamine, N-methyl-, N-ethyl-and N-cyclohexylmorpholine, N,N,N',N'-tetramethylethylenediamine, N,N,N',N'-tetramethylbutanediamine or hexanediamine, N,N,N'-trimethyl isopropyl propylenediamine, pentamethyldiethylenetriamine, tetramethyldiaminoethyl ether, bis(dimethylaminopropyl)urea, dimethylpiperazine, 1-methyl-4-dimethylaminoethyl-piperazine, 1,2-dimethylimidazole, 1-azabicylo[3.3.0]octane and preferably 1,4-diazabicylol[2.2.2]octane, and alkanolamine compounds, such as triethanolamine, triisopropanolamine, N-methyl- and N-ethyldiethanolamine and dimethylethanolamine.

A surfactant and/or cell regulator may also be incorporated into the polyurethane. Specific examples of surfactants are salts of sulfonic acids, e.g., alkali metal salts or ammonium salts of dodecylbenzene- or dinaphthylmethanedisulfonic acid and ricinoleic acid. Other preferred surfactants include silicone-containing surfactant polymers. Specific examples of anti-foam agents include siloxane-oxyalkylene copolymers and other organopolysiloxanes, oxyethylated alkyl-phenols, oxyethylated fatty alcohols, paraffin oils, castor oil esters, ricinoleic acid esters, Turkey red oil and groundnut oil. Specific examples of cell regulators include paraffins, fatty alcohols, and dimethylpolysiloxanes. These reagents may aid in controlling surface wetting between the two layers used to make the composite article and assist with bonding mechanisms and/or allow for improved differential reactivity of the adhesion promoter.

For the purposes of the subject invention, fillers include conventional organic and inorganic fillers and reinforcing agents. More specific examples include inorganic fillers, such as silicate minerals, for example, phyllosilicates such as antigorite, serpentine, hornblends, amphiboles, chrysotile, and talc; metal oxides, such as aluminum oxides, titanium oxides and iron oxides; metal salts, such as chalk, barite and inorganic pigments, such as cadmium sulfide, zinc sulfide and glass, among others; kaolin (china clay), aluminum silicate and co-precipitates of barium sulfate and aluminum silicate, and natural and synthetic fibrous minerals, such as wollastonite, metal, and glass fibers of various lengths. Examples of suitable organic fillers are carbon black, melamine, colophony, cyclopentadienyl resins, cellulose fibers, polyamide fibers, polyacrylonitrile fibers, polyurethane fibers, and polyester fibers based on aromatic and/or aliphatic dicarboxylic acid esters, and in particular, carbon fibers.

Examples of suitable flame retardants are tricresyl phosphate, tris(2-chloroethyl) phosphate, tris(2-chloropropyl) phosphate, and tris(2,3-dibromopropyl) phosphate. A suitable flame retardant in compositions of the present invention comprises FYROL® PCF, which is a tris(chloro propyl)phosphate commercially available from Albright & Wilson.

In addition to the above-mentioned halogen-substituted phosphates, it is also possible to use inorganic or organic flame retardants, such as red phosphorus, aluminum oxide hydrate, antimony trioxide, arsenic oxide, ammonium polyphosphate (Exolit®) and calcium sulfate, expandable graphite or cyanuric acid derivatives, e.g., melamine, or combinations of two or more flame retardants, e.g., ammonium polyphosphates and melamine, and, if desired, corn starch, or ammonium polyphosphate, melamine, and expandable graphite and/or, if desired, aromatic polyesters, in order to flameproof the polyurethane.

Further details on the other conventional assistants and additives mentioned above can be obtained from the specialist literature, for example, from the monograph by J. H. Saunders and K. C. Frisch, High Polymers, Volume XVI, Polyurethanes, Parts 1 and 2, Interscience Publishers 1962 and 1964, respectively, or Kunststoff-Handbuch, Polyurethane, Volume VII, Carl-Hanser-Verlag, Munich, Vienna, 1st and 2nd Editions, 1966 and 1983; incorporated herein by reference.

The polyisocyanate reacts with the isocyanate-reactive resin, specifically with the polyol and the other components of the isocyanate-reactive resin, to form the polyurethane having urethane linkages. The polyisocyanate may also be a pre-polymer. That is, the polyisocyanate may be a polyisocyanate initiated pre-polymer including the polyisocyanate in a stoichiometric excess amount and a isocyanate-reactive resin component. This isocyanate-reactive resin component of the pre-polymer may be the same as the isocyanate-reactive resin described above. In any event, the polyisocyanates utilized in the subject invention preferably have an average functionality of greater than 2, most preferably 2.5 or more. This functionality provides for a greater crosslinking density which improves the overall dimensional stability of the composite article.

In a preferred embodiment of the subject invention, the polyisocyanate is a polymeric diphenylmethane diisocyanate (PMDI) having an average functionality of about 2.7. A suitable polyisocyanate is commercially available as LUPRANATE® M20S Isocyanate from BASF Corporation. However, this is not intended to be a limitation on the subject invention, the application of the adhesion promoter would be expected to react with other polyisocyanates as well. If the polyisocyanate is a polyisocyanate initiated pre-polymer, then it is preferably a PMDI initiated pre-polymer including the PMDI in a stoichiometric excess amount and the isocyanate-reactive resin component of the pre-polymer.

Other suitable organic polyisocyanates, defined as having 2 or more isocyanate functionalities, include, but are not limited to, conventional aliphatic, cycloaliphatic, araliphatic and aromatic isocyanates other than PMDI. Specific examples include: alkylene diisocyanates with 4 to 12 carbons in the alkylene radical such as 1,12-dodecane diisocyanate, 2-ethyl-1,4-tetramethylene diisocyanate, 2-methyl-1,5-pentamethylene diisocyanate, 1,4-tetramethylene diisocyanate, 1,6-hexamethylene diisocyanate; cycloaliphatic diisocyanates such as 1,3- and 1,4-cyclohexane diisocyanate as well as any combinations of these isomers, 1-isocyanato-3,3,5-trimethyl-5-isocyanatomethylcyclohexane (isophorone diisocyanate), 2,4- and 2,6-hexahydrotoluene diisocyanate as well as the corresponding isomeric combinations, 4,4'-2,2'-, and 2,4'-dicyclohexylmethane diisocyanate as well as the corresponding isomeric combinations and aromatic diisocyanates and polyisocyanates such as 2,4- and 2,6-toluene diisocyanate and the corresponding isomeric combinations 4,4'-, 2,4'-, and 2,2'-diphenylmethane diisocyanate and the corresponding isomeric combinations, combinations of 4,4'-, 2,4'-, and 2,2-diphenylmethane diisocyanates and polyphenylenepolymethylene polyisocyanates (crude MDI), as well as combinations of crude MDI and toluene diisocyanates. The organic di- and polyisocyanates can be used individually or in the form of combinations.

Additionally, so-called modified multivalent isocyanates, i.e., products obtained by the partial chemical reaction of organic diisocyanates and/or polyisocyanates may be used. Examples include diisocyanates and/or polyisocyanates containing ester groups, urea groups, biuret groups, allophanate groups, carbodiimide groups, isocyanurate groups, and/or urethane groups. More specific examples include organic, preferably aromatic, polyisocyanates containing urethane groups and having an NCO content of 33.6 to 15 weight percent, preferably 31 to 21 weight percent, based on the total weight, e.g., with low molecular weight diols, triols, dialkylene glycols, trialkylene glycols, or polyoxyalkylene glycols with a molecular weight of up to 6000; modified 4,4'-diphenylmethane diisocyanate or 2,4- and 2,6-toluene diisocyanate, where examples of di- and polyoxyalkylene glycols that may be used individually or as combinations include diethylene glycol, dipropylene glycol, polyoxyethylene glycol, polyoxypropylene glycol, polyoxyethylene glycol, polyoxypropylene glycol, and polyoxypropylene polyoxyethylene glycols or -triols. Prepolymers containing NCO groups with an NCO content of 29 to 3.5 weight percent, preferably 21 to 14 weight percent, based on the total weight and produced from the polyester polyols and/or preferably polyether polyols described above; 4,4'-diphenylmethane diisocyanate, combinations of 2,4'- and 4,4'-diphenylmethane diisocyanate, 2,4,- and/or 2,6-toluene diisocyanates or polymeric MDI are also suitable. Furthermore, liquid polyisocyanates containing carbodiimide groups having an NCO content of 33.6 to 15 weight percent, preferably 31 to 21 weight percent, based on the total weight, have also proven suitable, e.g., based on 4,4'- and 2,4'- and/or 2,2'-diphenylmethane diisocyanate and/or 2,4'- and/or 2,6-toluene diisocyanate. The modified polyisocyanates may optionally be mixed together or mixed with unmodified organic polyisocyanates such as 2,4'- and 4,4'-diphenylmethane diisocyanate, polymeric MDI, 2,4'- and/or 2,6-toluene diisocyanate.

To produce the polyurethane of the subject invention, the isocyanate-reactive resin and the polyisocyanate are reacted in such amounts that a stoichiometric excess of isocyanate results. The stoichiometric excess is defined as the number of equivalents of NCO groups divided by the total number of isocyanate-reactive equivalents multiplied by 100. The stoichiometric excess ranges from about 100 to less than about 120, preferably from about 102 to about 110. Alternatively, the stoichiometric excess can be expressed in parts by weight. Preferably, the excess polyisocyanate is from about 2 to about 10 parts by weight based on 100 parts by weight of the polyurethane.

The subject invention includes an adhesion promoter for promoting adhesion between the first and the second layers. The adhesion promoter includes an ethylenically unsaturated methacrylate monomer, an ethylenically unsaturated acrylate monomer, or combinations thereof. Because the adhesion promoter is methacrylate or acrylate-based, it is compatible with the first layer. It is believed that there is an affinity between the methacrylate and acrylate-based monomers and the first layer such that, during a dwell time, the monomers of the adhesion promoter can penetrate the interstitial spaces present in the first layer. More specifically, the monomers of the adhesion promoter are allowed to interact with the first layer and can compatibilize with the first layer.

The adhesion promoter has a hydroxy functional group that is reactive with the polyisocyanate from the polyurethane. Specifically, the hydroxy functional group of the adhesion promoter is reactive with the stoichiometric excess of polyisocyanate that is present in the polyurethane. Once the polyurethane interacts with the adhesion promoter, the hydroxy functional group of the monomer or monomers reacts with excess isocyanate to establish urethane linkages between the first and the second layers thereby enhancing the adhesion between the layers.

Overall, the bond between the first layer and the second is a cohesive bond. Under testing known in the art, cohesive bonds exhibit cohesive failure, which is a desired physical property. That is, upon attempts to manually pry apart the discrete layers of the composite article, the first layer and the polyurethane stick to each other thereby demonstrating that any bond between the first and the second layers is stronger than the discrete layers themselves. Another particular manner in which the bond between the first and the second layers may be evaluated is by measurement with an Instron Tester. With the Instron Tester, a tapered blade is utilized to pry apart the bond between the first layer and the polyurethane. Then, the force, or load, at failure of the bond is measured in lbs. per square inch. Preferably, the overall bond strength between the first and the second layers is resistant to a force of at least 100, more preferably of at least 200 lbs. per square inch.

The adhesion promoter comprises a first reactive end group selected from the group of an ethylenically unsaturated monomer, an ethylenically unsaturated acrylate monomer, an ethylenically unsaturated methacrylate monomer, or a combination thereof and a second reactive end group that is reactive with isocyanate. Preferably the second reactive end group is a hydroxyl group.

The adhesion promoter is dispersed in at least one of the first layer and the second layer and reacted into the first and second layers through differentially reactive groups such that the adhesion promoter is compatible with the first and second layers to improve adhesion therebetween. In one embodiment, the differentially reactive groups are preferably end groups. The differentially reactive end groups may include, but are not limited to, hydroxyl groups and acrylate groups. It is to be appreciated by one of ordinary skill in the art that differentially reactive means that the hydroxyl groups will react with the excess isocyanate in the second layer and the acrylate groups have an affinity for the unsaturated groups in the first layer. Preferably, the adhesion promoter is dispersed throughout at least one of the first layer and the second layer and more preferably dispersed throughout the second layer. The adhesion promoter can be dispersed by typical means of mixing known in the art The adhesion promoter is selected from the group of hydroxyaliphatic acrylate, hydroxyaliphatic methacrylate, and combinations thereof. Each of the hydroxyaliphatic acrylate, hydroxyaliphatic methacrylate, and combinations thereof have an aliphatic chain with up to 20 carbon atoms therein. Preferably, the adhesion promoter is selected from the group of hydroxyethyl methacrylate, hydroxypropyl methacrylate, hydroxybutyl methacrylate, hydroxyethyl acrylate, hydroxypropyl acrylate, hydroxybutyl acrylate, and combinations thereof. More preferably, the adhesion promoter comprises hydroxyethyl methacrylate (HEMA) or hydroxyethyl acrylate. Other suitable monomers include, but are not limited to, hydroxypropyl methacrylate, butanediol monoacrylate, and glycerin dimethacrylate.

The adhesion promoter is present in an amount of from about 1 to about 20 parts by weight based on 100 parts by weight of either one of the polyurethane and the polymer. Preferably, the adhesion promoter is present in an amount of from about 1 to about 10 parts by weight based on 100 parts by weight of either one of the polyurethane and the polymer. It is to be appreciated that when the adhesion promoter is dispersed in the polyurethane, the amount present is based on the polyurethane and vice versa when the when adhesion promoter is dispersed in the polymer.

The subject invention further provides a method of forming the composite article. The method comprises casting the first layer and the second layer in contact with the first layer and dispersing the adhesion promoter throughout one of the first and the second layers prior to casting. The method further comprises reacting the adhesion promoter into the first and second layers through differentially reactive groups such that the adhesion promoter is compatible with the first and second layers to improve adhesion therebetween. The adhesion promoter is present in an amount from about 1 to about 20 parts by weight based on 100 parts by weight of either one of the polyurethane and the polymer. The casting process may be accomplished by various methods known in the art, such as, but are not limited to, high and low pressure open and closed mold pours, spray, and vacuum assisted resin transfer.

The related art methods have used adhesion promoters by wiping or spraying the adhesion promoter directly onto the first layer prior to casting the second layer. There is additional time required to perform the additional step and there is adequate assurances that the adhesion promoter has sufficiently bonded with the first layer prior to casting the second layer. Therefore, the subject invention sought to reduce the time of manufacturing and to provide assurances that the first and second layers would be adequately bonded.

After the first layer has been cast, the first layer is allowed to cure for a desire amount of time. As one example, the first layer when formed form a polyester, may reach a full cure within 12 hours. Prior to reaching a full cure, the surface of the first layer may be sticky or tacky to the touch. In other words, as the first layer cures, the surface of the first layer becomes tacky or sticky to the touch, which indicates that the first layer is curing. The length of time that the first layer is allowed to cure is dependent on the ability of the second layer to wet the surface and allow the adhesion promoter to interact with the chemistry of the second layer, through the proposed mechanism of differential reactivity. Longer cure times tend to increase the degree of cure of the first layer. The second layer may be applied to a tacky and/or sticky surface of the first layer at relatively short first layer cure times.

It has been determined that different amounts of adhesion may be obtained depending upon the location of the adhesion promoter and the amount of cure obtained by the first layer prior to casting the second layer. In one embodiment, when the adhesion promoter is dispersed in the first layer, the second layer may be cast at any point because the adhesion promoter has already been homogenously dispersed through the first layer. In other words, the second reactive end group of the adhesion promoter will be present on the surface of the first layer and available to react with the second layer when it is cast.

In one embodiment, the step of dispersing the adhesion promoter is further defined as dispersing the adhesion promoter throughout the second layer prior to the first layer obtaining a full cure. It is believed that first reactive end group of the adhesion promoter needs the first layer to be partially uncured in order to exude into or have an affinity with the first layer. If the first layer is fully cured, then the first reactive end group is not able to sufficiently bond with the first layer. Thus, it is preferable that the step of casting the second layer in contact with the first layers occurs prior to the first layer obtaining a full cure, and more preferably the step of casting the second layer in contact with the first layers occurs within six hours after casting the first layer. When the adhesion promoter is dispersed through the second layer, the adhesion promoter is present in an amount from about 1 to about 20 parts by weight based on 100 parts by weight of the polyurethane.

The following examples illustrating the formation of the composite article according to the subject invention, as presented herein, are intended to illustrate and not limit the invention.

EXAMPLES

Composite articles are prepared by casting a first layer and a second layer in contact with the first layer. The first layer is formed the polymer being an unsaturated polyester as indicated in the following Examples. The second layer is formed from the polyurethane adding and reacting the following parts, by percent, unless otherwise indicated.

TABLE 1

| Polyurethane 1 (PP1) | | Polyurethane 2 (PP2) | |
|---|---|---|---|
| PLURACOL ® 736 | 35 | QUADROL ® | 25.25 |
| PLURACOL ® 2097 | 53 | PLURACOL ® GP730 | 14.75 |
| FOAMREZ UL-32 (Catalyst) | 0.004 | TXIB (Plasticizer) | 60 |
| DEG (Chain Extender) | 11.996 | — | — |
| TOTAL | 100 | TOTAL | 100 |

Each of the above polyurethanes were reacted with LUPRANATE® M20S to form the second layer. The amount of the polyisocyanate used is based upon the desired stoichiometric excess of polyisocyanate. For the polyurethane 1, 67.06 grams of polyisocyanate is used resulting in a stoichiometric excess of about 5%. For the polyurethane 2, 70.1 grams of polyisocyanate is used resulting in a stoichiometric excess of 5%.

The polymer forming the first layer used in the Examples is an unsaturated polyester from Cook Composites, Stypol LSPF-2522 (hereinafter Stypol), or an unsaturated polyester LB 6541-004 from Ashland Specialty Chemicals.

The following table summarizes the amount of the adhesion promoter, HEMA, and where the HEMA was dispersed, i.e., the first or the second layer.

TABLE 2

| | 1st Layer | 2nd Layer | Adhesion promoter Location | Adhesion promoter Amount, % | Processing Conditions |
|---|---|---|---|---|---|
| Ex. 1 | Ashland | PP1 | 1st Layer | 0 | 2 hour polyester cure prior to overcast, hard dry slightly tacky surface |
| Ex. 2 | Ashland | PP1 | 1st Layer | 2.5 | 2 hour polyester cure prior to overcast, hard dry slightly tacky surface |
| Ex. 3 | Ashland | PP1 | 1st Layer | 5 | 2 hour polyester cure prior to overcast, hard dry slightly tacky surface |
| Ex. 4 | Ashland | PP1 | 1st Layer | 10 | 2 hour polyester cure prior to overcast, hard dry slightly tacky surface |
| Ex. 5 | Stypol | PP1 | 1st Layer | 0 | ~1.5 hour polyester cure prior to overcast, gelled sticky surface. |
| Ex. 6 | Stypol | PP1 | 1st Layer | 2.5 | ~1.5 hour polyester cure prior to overcast, gelled sticky surface. |

TABLE 2-continued

| | 1st Layer | 2nd Layer | Adhesion promoter Location | Adhesion promoter Amount, % | Processing Conditions |
|---|---|---|---|---|---|
| Ex. 7 | Stypol | PP1 | 1st Layer | 5 | ~1.5 hour polyester cure prior to overcast, gelled sticky surface. |
| Ex. 8 | Stypol | PP1 | 1st Layer | 10 | ~1.5 hour polyester cure prior to overcast, gelled sticky surface. |
| Ex. 9 | Stypol | PP1 | 1st Layer | 0 | ~12 hour polyester cure prior to overcast, "full cure". |
| Ex. 10 | Stypol | PP1 | 1st Layer | 2.5 | ~12 hour polyester cure prior to overcast, "full cure". |
| Ex. 11 | Stypol | PP1 | 1st Layer | 5 | ~12 hour polyester cure prior to overcast, "full cure". |
| Ex. 12 | Stypol | PP1 | 1st Layer | 10 | ~12 hour polyester cure prior to overcast, "full cure". |
| Ex. 13 | Stypol | PP2 | 1st Layer | 0 | ~1.5 hour polyester cure prior to overcast, hard sticky surface. |
| Ex. 14 | Stypol | PP2 | 1st Layer | 2.5 | ~1.5 hour polyester cure prior to overcast, hard sticky surface. |
| Ex. 15 | Stypol | PP2 | 1st Layer | 5 | ~1.5 hour polyester cure prior to overcast, hard sticky surface. |
| Ex. 16 | Stypol | PP2 | 1st Layer | 10 | ~1.5 hour polyester cure prior to overcast, hard sticky surface. |
| Ex. 17 | Stypol | PP1 | 2nd Layer | 10 | ~1.5 hour polyester cure prior to overcast, gelled surface sticky. |
| Ex. 18 | Stypol | PP2 | 2nd Layer | 10 | ~1.5 hour polyester cure prior to overcast, gelled surface sticky. |

Test plaques measuring 5 inches wide by 10 inches long and ¼ inch thick were prepared as set forth in Table 2. The test plaques had ⅛ inch of the first layer and ⅛ inch of the second layer. The test plaques were subjected to a pull test to determine the amount of adhesion between the layers using ASTM method D4541. In this test, 1 inch circular pull tabs are glued to each of the plaques, after the adhesive dried a 1 inch hole saw drill was used to cut around the 1 inch pull tabs, in some cases the release of the intrinsic stresses caused to layers to separate. In those cases additional tabs were applied to the composite article for adhesion testing. The following table summarizes the results of the test.

TABLE 3

| | Ave. Adhesion, psi | Drilling Comments |
|---|---|---|
| Ex. 1 | 428 | Separation occurred at interface of first and second layer when drilled. |
| Ex. 2 | 460 | Separation occurred at interface of first and second layer when drilled. |
| Ex. 3 | 608 | Separation occurred at interface of first and second layer when drilled. |
| Ex. 4 | 340 | Separation occurred at interface of first and second layer when drilled. |
| Ex. 5 | 137.5 | Separation occurred at interface of first and second layer when drilled. |
| Ex. 6 | 156 | Separation occurred at interface of first and second layer when drilled. |

TABLE 3-continued

| | Ave. Adhesion, psi | Drilling Comments |
|---|---|---|
| Ex. 7 | 247 | Separation occurred at interface of first and second layer when drilled. |
| Ex. 8 | 716 | Separation occurred at interface of first and second layer when drilled. |
| Ex. 9 | 180 | Separation occurred at interface of first and second layer when drilled. |
| Ex. 10 | 386 | Separation occurred at interface of first and second layer when drilled. |
| Ex. 11 | 260 | Separation occurred at interface of first and second layer when drilled. |
| Ex. 12 | 310 | Separation occurred at interface of first and second layer when drilled. |
| Ex. 13 | 370 | No separation at interface |
| Ex. 14 | 408 | Separation occurred at interface of first and second layer when drilled. |
| Ex. 15 | 352.5 | Partial separation at interface/partial separation at first layer |
| Ex. 16 | 260 | Separation occurred at interface of first and second layer when drilled. |
| Ex. 17 | 828 | No separation at interface |
| Ex. 18 | 740 | No separation at interface |

There are two factors leading to the bonding of the first and the second layers. First, there are adhesive forces defined generally as surface attraction and interaction between the two layers. Such surface attractions may include dipole moments and wetting phenomena. Second, there are cohesive forces defined generally as covalent, chemical bonding between the two layers. Referring to Examples 1-4, the adhesion values increased as the amount of the HEMA increased up to 5%. Once the HEMA exceeded 5%, the adhesion value decreased. In Example 1 with 0% HEMA, the adhesion value was 428 psi. When 2.5% HEMA was added, the value increased by about 48 psi and when 5% was added the value increased by about 180 psi. However, when 10% was added, the value dropped by about 88 psi. Initially, with 0% HEMA, there were strong adhesive forces present. When a small amount of HEMA was added, 2.5%, the HEMA did not significantly interact to provide cohesive forces. However, when 5% was added, the cohesive forces contributed significantly to the adhesive value. Note that when too much HEMA was added, the HEMA disrupted the adhesive forces and did not contribute to the cohesive forces resulting in a less strong bond between the first and second layers. In other words, the adhesive values plateaus around 5% HEMA and adding more will not improve adhesion. Even though the strength of the bond was adequate for Example 3, when the plaque was drilled, the separation between the layers occurred at the interface. This indicates that the bond between the layers was not optimal.

Referring to Examples 5-8, the adhesion values increased as the amount of the HEMA increased. Until the HEMA exceeded 5%, the adhesion value only increased slightly. In Example 5 with 0% HEMA, the adhesion value was 137.5 psi. In comparison with Example 1, the lower adhesion value results from the different first layer. When 10% was added, the value significantly increased to about 716 psi. Again, with less than 5% HEMA, the adhesion value was primarily contributed to adhesive forces that were present between the layers. Even though the strength of the bond was adequate for Example 8, when the plaque was drilled, the separation between the layers occurred at the interface. This indicates that the bond between the layers was not optimal.

Referring to Examples 9-12, the adhesion values increased with a minimal amount of HEMA being added and peaked around 2.5% HEMA. Adding more HEMA resulting the adhesive value decreasing, while still being above Example 9. Again, it is believed that the cohesive forces did not contribute to the adhesion value beyond 2.5% HEMA being added and instead interfered with the adhesive forces. Each of the plaques separated between the layers at the interface, indicating that the bond between the layers was not optimal. It should be noted that the second layer was cast after the first layer had obtained a full cure.

Referring to Examples 13-16, the polyurethane 2 was used in place of the polyurethane 1. The adhesion values were initially higher than those of Example 5, which was made with the polyurethane 1. However, the addition of the HEMA did not result in increased adhesive values. Instead, the HEMA appears to have interfered with the adhesive forces resulting in lower adhesive values. Even though the strength of the bond was weaker, Examples 14 and 16 did not separate at the interface between the layers when the plaque was drilled. This indicates that the bond between the layers was improved, but the low adhesion values were not optimal.

Referring to Examples 17-18, the HEMA was dispersed throughout the second layer prior to casting. The adhesion values were significantly higher than when the HEMA was incorporated in the first layer. Further, the plaques did not separated at the interface when drilled. Therefore, it is preferred in disperse the HEMA throughout the second layer to provide optimal adhesive values and bond strength.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A composite article comprising:

a first layer comprising a polymer resulting from the reaction of at least one ethylenically unsaturated monomer;

a second layer different than said first layer and comprising a polyurethane resulting from the reaction of a isocyanate-reactive resin and a polyisocyanate; and an adhesion promoter comprising a first reactive end group selected from the group of ethylenically unsaturated monomers, ethylenically unsaturated acrylate monomers, ethylenically unsaturated methacrylate monomers, and combinations thereof and a second reactive end group that is reactive with isocyanate, and wherein said adhesion promoter is dispersed in at least one of said first layer and said second layer and reacted into said first and second layers through differentially reactive groups such that said adhesion promoter is compatible with said first and second layers to improve adhesion therebetween.

2. A composite article as set forth in claim 1 wherein said adhesion promoter is dispersed throughout at least one of said first layer and said second layer.

3. A composite article as set forth in claim 2 wherein said adhesion promoter is dispersed throughout said second layer.

4. A composite article as set forth in claim 1 wherein said polyurethane is further defined as the reaction product of said isocyanate-reactive resin and a stoichiometric excess of said polyisocyanate relative to said isocyanate-reactive resin.

5. A composite article as set forth in claim 4 wherein said stoichiometric excess of said polyisocyanate is from about 2 to about 10 parts by weight based on 100 parts by weight of said polyurethane.

6. A composite article as set forth in claim 1 wherein said second layer surrounds said first layer.

7. A composite article as set forth in claim 6 wherein said first and second layers are spherical and concentric.

8. A composite article as set forth in claim 6 wherein said first layer is further defined as a core and said second layer is further defined as a coverstock such that said coverstock surrounds said core.

9. A composite article as set forth in claim 8 wherein said composite article is further defined as a bowling ball.

10. A composite article as set forth in claim 1 wherein said second layer has a thickness of from about 0.33 inches to about 2.0 inches.

11. A composite article as set forth in claim 1 wherein said adhesion promoter comprises hydroxyethyl methacrylate or hydroxyethyl acrylate.

12. A composite article as set forth in claim 1 wherein said adhesion promoter is selected from the group of hydroxyethyl methacrylate, hydroxypropyl methacrylate, hydroxybutyl methacrylate, hydroxyethyl acrylate, hydroxypropyl acrylate, hydroxybutyl acrylate, and combinations thereof.

13. A composite article as set forth in claim 1 wherein said adhesion promoter is selected from the group of hydroxyaliphatic acrylate, hydroxyaliphatic methacrylate, and combinations thereof, wherein each of the hydroxyaliphatic acrylate, hydroxyaliphatic methacrylate, and combinations thereof have an aliphatic chain with up to 20 carbon atoms therein.

14. A composite article as set forth in claim 1 wherein said adhesion promoter is present in an amount of from about 1 to about 20 parts by weight based on 100 parts by weight of either one of said polyurethane and said polymer depending on which one said adhesion promoter is dispersed in.

15. A composite article as set forth in claim 1 wherein said polymer is selected from the group of unsaturated polyesters, ethylenically unsaturated monomers, ethylenically unsaturated acrylate monomers, ethylenically unsaturated methacrylate monomers, and combinations thereof.

16. A composite article as set forth in claim 1 wherein said polymer is selected from the group of acrylates, polyesters, and combinations thereof.

17. A method of forming a composite article, said method comprising:

casting a first layer comprising a polymer resulting from the reaction of at least one ethylenically unsaturated monomer;

curing the first layer to a desired amount of cure;

casting a second layer different than the first layer and comprising a polyurethane resulting from the reaction of a isocyanate-reactive resin and a polyisocyanate in contact with the first layer when the first layer has achieved the desired amount of cure;

dispersing an adhesion promoter throughout one of the first and the second layers prior to casting, the adhesion promoter comprising a first reactive end group selected from the group of ethylenically unsaturated monomers, ethylenically unsaturated acrylate monomers, ethylenically unsaturated methacrylate monomers, and combinations thereof and a second reactive end that is reactive with isocyanate; and reacting the adhesion promoter into the first and second layers through differentially reactive groups such that the adhesion promoter is compatible with the first and second layers to improve adhesion therebetween.

18. A method as set forth in claim 17 wherein the step of casting the second layer in contact with the first layer occurs prior to the first layer obtaining a full cure.

19. A method as set forth in claim 17 wherein the step of casting the second layer in contact with the first layers occurs within six hours after casting the first layer.

20. A method as set forth in claim 17 wherein the step of dispersing the adhesion promoter is further defined as dispersing the adhesion promoter throughout the second layer prior to the first layer obtaining a full cure.

21. A method as set forth in claim 20 wherein the adhesion promoter is present in an amount from about 1 to about 20 parts by weight based on 100 parts by weight of said polyurethane.

22. A method as set forth in claim 17 wherein the adhesion promoter is present in an amount from about 1 to about 20 parts by weight based on 100 parts by weight of either one of said polyurethane and said polymer depending on which the said adhesion promoter is dispersed in.

23. A method of forming a composite article, said method comprising:

reacting at least one ethylenically unsaturated monomer to form a first layer;

curing the first layer to a desired amount of cure;

reacting an isocyanate-reactive resin and polyisocyanate in contact with the first layer when the first layer has achieved the desired amount of cure to form a second layer different than the first layer; and homogenously dispersing an adhesion promoter comprising a first reactive end group selected from the group of ethylenically unsaturated monomers, ethylenically unsaturated acrylate monomers, ethylenically unsaturated methacrylate monomers, and combinations thereof and a second reactive end group that is reactive with isocyanate throughout one of the first and the second layers prior to reacting such that the first and second layers are adhered through differentially reactive groups.

24. A method as set forth in claim 23 wherein the step of homogenously dispersing the adhesion promoter is further defined as dispersing the adhesion promoter in the isocyanate-reactive resin prior reacting with the polyisocyanate.

* * * * *